United States Patent [19]

Peloggio

[11] Patent Number: 4,573,419

[45] Date of Patent: Mar. 4, 1986

[54] DEVICE FOR THREADING KNIT ARTICLES ONTO THE PIN HOLDER RING OF A LINKING MACHINE

[75] Inventor: Alessandro Peloggio, Brignano Gera D'Adda, Italy

[73] Assignee: Exacta S.p.A., Brignano Gera D'Adda, Italy

[21] Appl. No.: 570,554

[22] Filed: Jan. 13, 1984

[30] Foreign Application Priority Data

Jan. 27, 1983 [IT] Italy ..... 19305 A/83

[51] Int. Cl.[4] ..... D05B 7/00

[52] U.S. Cl. ..... 112/27

[58] Field of Search ..... 112/25, 26, 27

[56] References Cited

U.S. PATENT DOCUMENTS

| | | | |
|---|---|---|---|
| 2,632,414 | 3/1953 | Lomax et al. | 112/27 |
| 2,948,240 | 8/1960 | Burd et al. | 112/27 |
| 3,487,797 | 1/1970 | Peloggio | 112/27 |

*Primary Examiner*—Ronald Feldbaum

*Attorney, Agent, or Firm*—Guido Modiano; Albert Josif

[57] ABSTRACT

For orderly threading knit articles, preferably in the form of knit hems, onto the pin holder ring of a linking machine, a device is disclosed which comprises, in a supporting frame associated with the linking machine, a comb-like element having a plurality of coplanar dents arranged facing the ring pins, and arranged tangentially to the pin holder ring and movably associated with the supporting frame. The comb-like element may be connected kinematically to the pin holder ring to achieve a translation speed which is substantially equal to the peripheral rotation speed of the pin holder ring during a knitwork threading stroke. Associated with the supporting frame is a transfer assembly cooperating with the dents of the comb-like element, and an element is provided for picking up one of the knit articles threaded onto the comb-like element to set it into an advanced position on the dents.

8 Claims, 6 Drawing Figures

DEVICE FOR THREADING KNIT ARTICLES ONTO THE PIN HOLDER RING OF A LINKING MACHINE

BACKGROUND OF THE INVENTION

This invention relates to a device for threading knit articles onto the pin holder ring of a linking machine.

As is known, a linking operation requires that the articles involved be threaded onto the pin holder ring of a linking machine.

The operation is a high-cost one because it implies a particularly accurate procedure and the availability of highly qualified personnel for inserting adjacent loops of the knitwork onto adjacent pins on the linking machine ring.

The manually performed operation is both difficult and expensive to complete, and methods and devices have been developed which are directed to expedite the knitwork threading.

Known are for example random threading devices for knitwork, which require a comparatively orderly arrangement of an article onto the pin holder ring without, however, involving true alignment of the knitwork loops with the pins, thereby an inferior quality product is obtained over a properly carried out linking operation.

In particular, where the linking operation relates to application of hems to processed articles, the critical aspect of the threading step concerns the moment a hem is placed on the pin holder ring, because it is only at this time that, to achieve a high quality product, it is necessary to provide for alignment of the knitworks by threading adjacent loops onto adjacent pins in the pin holder ring, since on completion of the product only an outer face is left in view.

In consideration of the hem producing machine allowing the hems to be threaded automatically onto a comb-like element in an orderly fashion, i.e. providing the cited alignment of adjacent knitworks, machines have also been developed to feed linking machines designed to process knit articles in the open form, which cannot, therefore, be used in practice where pre-formed articles are to be processed which have, for example, ring-like hem application regions.

SUMMARY OF THE INVENTION

In view of the above-described technical problems, it is a primary object of the invention to obviate such prior deficiencies by providing a device for threading knit articles onto the pin holder ring of a linking machine, which enables said articles to be threaded in an automatic and orderly fashion with a minimum of human intervention.

Another object of the invention is to provide a a knit article feeding device which can ensure a high hourly production rate.

It is a further object of this invention to provide a device which requires no qualified personnel and, at the same time, can minimize the damage caused to the knitwork in threading onto the pin holder ring, as due to the mechanical stress applied thereto in the course of said threading step.

Still another object of the invention is to provide a device for feeding knit articles onto the pin holder ring of a linking machine, which is adapted for selection of the article to be fed onto the cited ring by preliminarly setting it gradually for threading.

These and other objects are achieved by a device for threading knit articles onto the pin holder ring of a linking machine according to the invention, which is characterized in that it comprises, in a supporting frame associated with said linking machine, a comb-like element having a plurality of coplanar dents facing said pins, said element being arranged tangentially to said pin holder ring and movably associated with said supporting frame and being connectable kinematically to said pin holder ring to achieve a translation speed substantially equal to the peripheral speed of rotation of said pin holder ring during a knit article threading stroke, a transfer assembly cooperating with said dents, and a means for picking up one of said knit articles threaded onto said comb-like element to pre-arrange it into an advanced position on said dents.

Advantageously, said comb-like element is removably associated and motion-wise rigid with a carriage arranged to slide along a runway extending in a substantially tangential direction to said pin holder ring, and a means is provided for kinematically and selectively connecting said carriage to said pin holder ring or to an auxiliary drive means.

BRIEF DESCRIPTION OF THE DRAWINGS

Further features and advantages will be more clearly understood from the following detailed description of a preferred, but not exclusive, embodiment of the invention, with reference to the accompanying illustrative, but not limitative, drawings, where.

DESCRIPTION OF THE PREFERRED EMBODIMENTS

Figure 1:
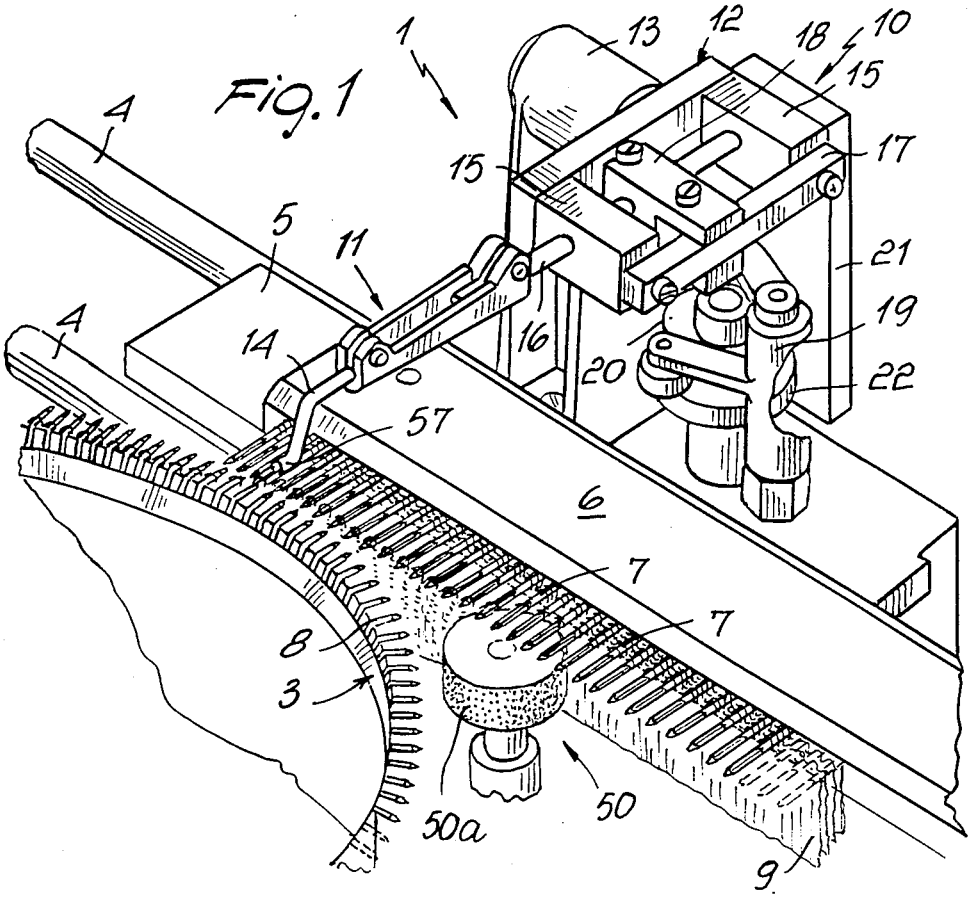
FIG. 1 is a perspective diagramatic view of the inventive device.

Making reference to the drawing views, a device according to this invention is generally indicated at 1. It comprises essentially a supporting frame 2 associable with a linking machine of the type including a pin holder ring 3.

The frame 2 has a runway 4, extending in a substantially tangential direction to the pin holder ring, wherealong a carriage 5 can slide which carries a detachable comb-like element 6. The comb-like element 6 has a plurality of dents 7 which are coplanar with one another and arranged to face the pins 8 on the holder ring 3.

Knit articles are threaded onto the comb-like element 6. The articles may comprise hems 9 so applied as to leave the knitwork loops thereof orderly slid on the pins 7.

That arrangement can easily be achieved in fabricating the hems on conventional machines.

In order to thread one of said hems onto the pin holder ring 3, the device of this invention is equipped with a transfer assembly 10, which comprises essentially a tool holder assembly 11 carried slidable in the direction of the pins 7 on a rocking frame 12, which is in turn pivoted through a bracket 13 to the supporting frame 2.

Connected adjustably to the tool holder assembly 11 is a tool 14 adapted to cooperate with the pins 7 in transferring one of the hems 9 onto the linking machine pins 8.

The frame 12 includes a pair of small end blocks 15, wherethrough a rod 16 of the tool holder assembly is arranged to slide substantially parallel to and in cooperation with a guide element 17 secured between the blocks 15. The rod 16 is driven through a clamp 18 which is connected, via a linkage 19, to a translation movement cam 20.

The rocking frame 12 is further connected, with the intermediary of a bar 21, to a rocking movement cam 22 preferably coaxial with the translation cam 20 and made rigid therewith motion-wise, being both keyed on a first shaft 23.

The shaft 23 is, in turn, connected kinematically to the pin holder ring 3 so as to move in synchornism with the rotary motion of the latter; that connection may be provided by a drive element 23*a*, whereby the drive motion imparted to the linking machine, such as through a drive belt 23*b*, is related to the motion of the transfer assembly 10.

The shaft 23 cooperates, via a linkage 24, with a second drive shaft 25 which is keyed slidably onto a first clutch element 26.

With a single command, e.g. as supplied through a lever 30 pivoted to a sleeve 29 sliding on the shaft 25 and acting on a yoke-like bridge 27 which cooperates, in turn, with the first clutch element 26 or with a second clutch element 28 keyed slidably on a third drive shaft 31, one can control the concurrent translation, along respective shafts 25,31, of both clutch elements 26,28 such that the first thereof engages, or alternatively releases, a first wheel 32, set idle on the shaft 25 and in constant mesh with a second wheel 33 keyed on the shaft 31, and the second thereof releases, or alternatively engages, an auxiliary drive means such as an auxiliary motor 34 kinematically connected to a drive element 35 mounted idle on the shaft 31.

Also mounted on the shaft 31 is a pinion gear 36 which engages with a rack 37 made rigid with the carriage 5, thereby controlling the translation movement of the carriage tangentially to the pin holder ring 3.

Thus, it becomes possible to selectively connect the carriage 5, and accordingly the comb-like element 6, to the rotary drive imparted to the pin holder ring 3, or to the auxialiry drive means 34, so as to differentiate the translation speeds of the cited carriage 5, respectively during a kint article threading stroke and return stroke, when the carriage itself, and hence the comb-like element 6, on completing the transfer of one of the hems 9 to the pin holder ring 3, moves into its initial position to make ready for threading on another hem. The clutch elements, a well as the wheels associated therewith and the sleeve 29, thus form a switch-over device for the kinematic connection of the carriage 5 to said pin holder ring, or alternatively, to the auxiliary drive means.

Advantageously, a means is provided for kinematically and selectively connecting the carriage 5 to the pin holder ring 3 or to the auxiliary drive means 24 by acting on the switch-over device just described.

The latter means comprises essentially a rocker arm element 40 pivoted to the supporting frame 2 at a position where it can interfere with cams 41 carried, preferably at an adjustable position, on the carriage 5. The rocker arm element acts, through deflectors 42 of a conventional type, on the lever 30 to drive the switch-over device and provide for automatic return of the carriage 5 to the initial position at the end of the threading stroke of the hem 9 onto the pin holder ring 3.

It is also important that during said threading stroke the translation speed of the comb-like element 6 be maintained consistently equal to the peripheral speed of the pins 8 of the linking machine, such that for each dent 7 on the comb-like element 6 there corresponds a facing pin 8, to make the transfer of the hem 9 easier.

It is evidently important to remove any interference between the transfer member 10 and comb-like element 6 during the return stroke of the carriage 5. This is accomplished by providing a disengagement means for the tool holder assembly 11 which comprises a rod 45 acting, via an optionally elastically biased link 46, on the bar 21 to disengage the rocking frame 12 from the rocking movement cam 22, holding the tool 14 raised off the comb-like element 6.

To that aim, the rod 45 is supplied, in that it is connected rigidly to the sleeve 29, with a command related to the action of the cams 41 on the rocker arm 40; that command, as transmitted through the link 46, holds the tool holder assembly 11 at a safe position, thus preventing any possible interference of the tool 14 with the dents 7 on the comb-like element 6.

Also provided is a means for selecting one of the knit articles, specifically that of the hems 9 directly facing the pin holder ring 3, setting it in an advanced position on the dents 7 of the comb-like element 6.

Said means advantageously comprises a small cylinder 50, which is supported rotatably by an arm 51 and optionally driven rotatively synchronously with the advancing movement of the carriage 5, e.g. by means of a flexible drive 52 one end whereof is connected to the cylinder 50 and the other end is connected kinematically, through a wheel pair 53, to the drive shaft 31.

The arm 51 is pivoted to a bracket 54, made rigid with the supporting frame 2, and is driven by a link assembly 55 which cooperates with the sleeve 29 via a pad 47 and is subjected, therefore, to the selection effected by the rocker arm 40 to bring the cylinder 50 close to the hem 9 facing directly the pin holder ring 3 during the threading stroke and move the cited cylinder 50 away in order to avoid any interference with the hems during the return stroke.

The small cylinder 50 preferably performs its function of selecting one of the knit articles by means of a liner 50*a*, e.g. of an adhesive type or preferably of a hooked pile type, in close contact with the hem 9 as the latter is being translated by the comb-like element 6, to then release it after setting it preliminarly into an advanced position on the dents 7.

In a preferred embodiment, the tool 14 is in the form of a small brush 56 sloping toward the pin holder ring 3 in the direction of advance during the threading step; that solution affords the advantage of effecting a gentler treatment of the knitwork during the threading thereof, and of packing the threaded knitworks pushing them for a longer distance over the pins 8 without causing the loops to become stretched or spread wide as they undergo a sharp deformation by the tool 14.

In accordance with this solution, in fact, the knitwork loops are led gradually over from the dents 7 onto the pins 8 without undergoing any sharp changes in direction.

A possible alternative provides instead for the tool to be configured to present a needle point 57, adapted to engage in grooves 58 formed in the upper portion of the dents 7 on the side facing the pin holder ring 3 so as to insert itself under one of the loops 60, present on the comb-like element 6, to lay it onto the corresponding pin 8 facing the dent 7 and being rigid with the ring 3.

The detachable connection of the comb-like element 6 to the carriage 5 may be embodied by quick release devices 61, so as to allow a prompt replacement of the comb-like element 6 on completion of the threading on of the hems laid on it, and thus reduce the downtime for preparing the inventive device and further improve the linking machine output.

The device for threading knit articles according to the invention operates as follows.

The drive imposed through the drive element 24, which synchronizes the first shaft 23 to the pin holder ring 3 of the linking machine, involves rotation of the cams 20 and 22; the rocking movement cam 22, in engaging the bar 21 of the frame 12, causes a rocking movement thereof to take place about its pivot point on the bracket 13, thus causing the tool 14 to be raised and lowered.

Simultaneously and synchronously with this movement, the translation cam 20 acts, through the linkage 19, on the clamp 18 to impart the tool holder 11 carried on the blocks 15 with a sliding motion.

Figure 2:
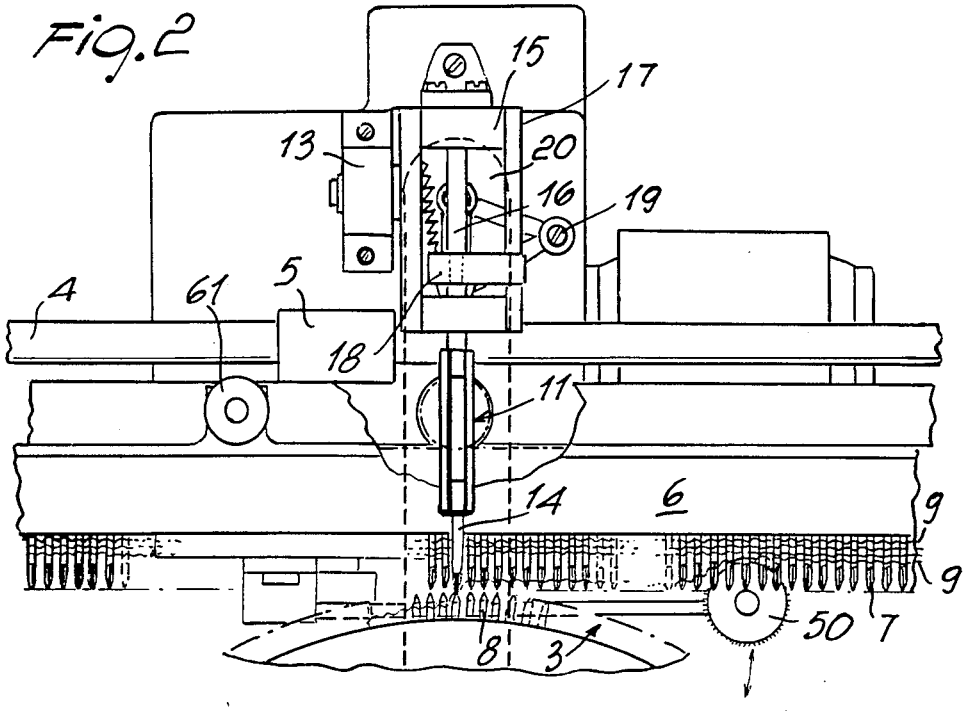
FIG. 2 is a to plan view of this knit article threading device.
Figure 3:
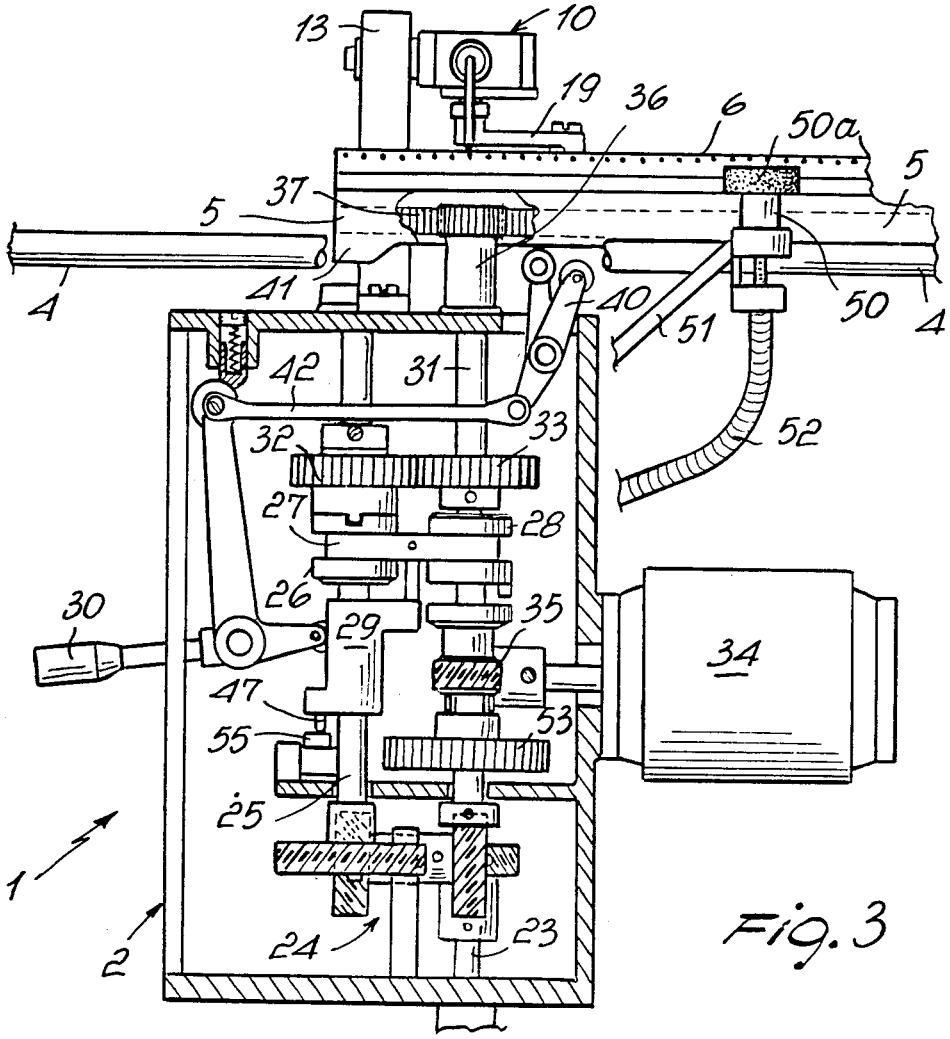
FIG. 3 is a fragmentary sectional view of the inventive device as viewed from the linking machine pin holder ring side.
Figure 4:
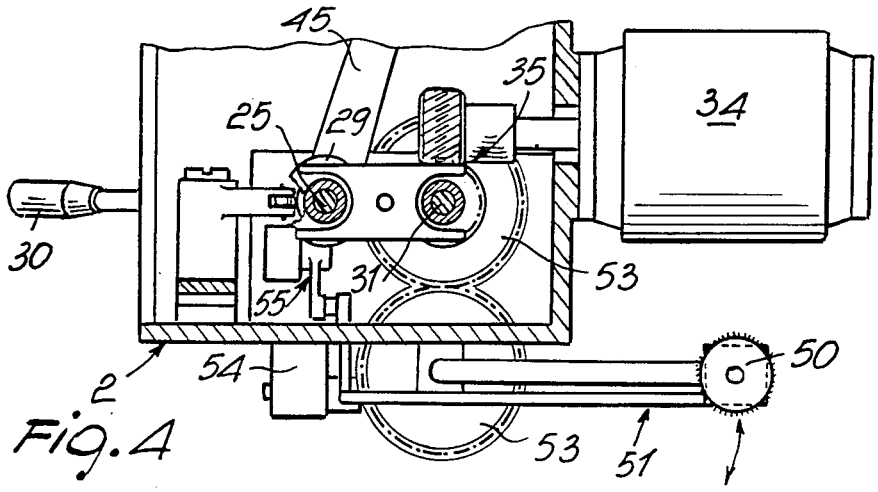
FIG. 4 is a fragmentary sectional view from above of that same device.
Figure 5:
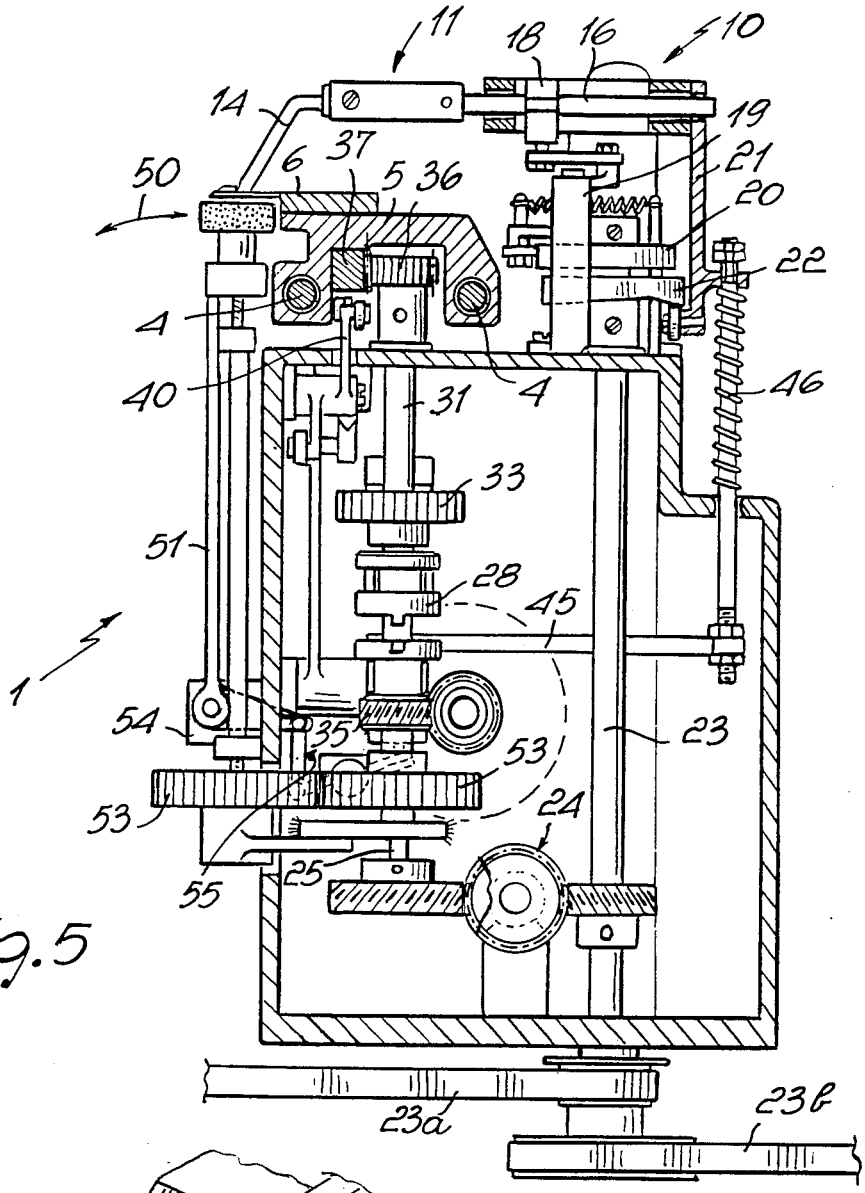
FIG. 5 is a side section view of the device of this invention.
Figure 6:
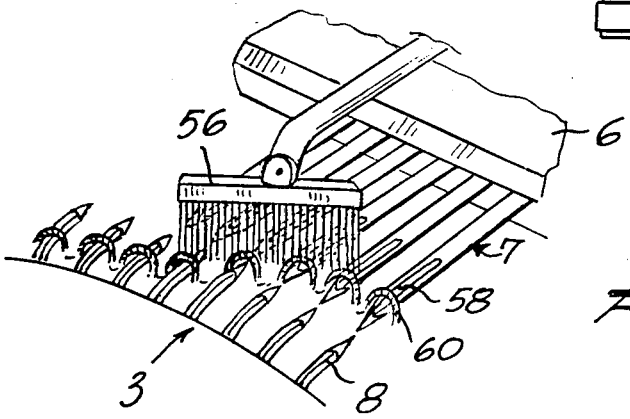
FIG. 6 shows a detail of a transfer tool during the knit article transfer stage.

The resulting combined motion is transmitted through the tool 14 to one of the loops 60 of the hem threaded onto the comb-like element 6, causing it to be transferred onto the pin holder ring 3; in fact, during an initial stage, the tool 14 will move into a position rearward of the dents 7 and included between the hem 9, pre-arranged in an advanced position on the dents 7 and hence ready to be thread on, and the remaining hem pack left at a trailing position on the dents 7 as shown in FIG. 2.

The next step is a merely translational one and involves picking up the loop to take it to the corresponding pin 8 of the linking machine. After releasing the corresponding loop, the tool 14 is again raised into a preparatory position to threading on an adjacent loop.

Simultaneously therewith, the motion transmitted to the shaft 23 is transmitted through the assembly 24 to the second drive shaft 25, thus rotating the clutch element 26 which, if engaged with the wheel 32, will transmit that motion to the shaft 3 because made rigid motion-wise with the wheel 33.

In this condition, which corresponds to the knit article threading step, the pinion gear 36 acts on the rack 37 to cause a progressive advancing movement of the carriage 5 which is correlated with the rocking motion of the transfer assembly 10 such as to effect a gradual and orderly transfer of the hem 9 selected on the pin holder ring 3.

Thus, the carriage 5 will advance until one of the cams 41, which has been obviously adjusted in accordance with the length of the hems 9 to be threaded, interferes with the rocker arm element 40, which acts on the switch-over device to effect the disengagement of the clutch element 26 from the wheel 32 and make instead rigid motion-wise together the clutch element 28 and auxiliary drive means, which may for example cause the carriage 5 to complete its return stroke at higher speed than the threading stroke.

On completion of the cited return stroke, the other of the cams 41 acts again on the rocker arm 40, resetting the switch-over device for a fresh threading stroke. When switched over for a return stroke, the sleeve 29 acts on the rod 45 which, as set forth hereinabove, causes disengagement of the bar 21 and consequently of the rocking frame 12 from the rocking motion cam 22 while holding the tool 14 constantly raised off the comb-like element.

At the same time, the small cylinder 50 is rotated by the wheels 53 and held in contact with the foremost of the hems 9 presented to it on the comb-like element 6; the engagement of the cited hem with the liner **50*a* located at the peripheral region thereof, combined with the rotary motion of the cylinder 50 and translatory motion of the hem 9, results in a gradual and homogeneous selection of the hem, which is transferred to the front region of the dents 7 facing the pin holder ring 3**, ready for threading.

At the end of the threading step, and hence at the end of the cited selection step, the link assembly 55 act on the arm 51 to exclude the cylinder 50 from its condition of engagement with the hems 9, so as to prevent interference or a possible release of the hem 9 from the comb-like element 6; of course, all such operations may be carried out in an automated mode owing to the provision of the cams 41, or alternatively, under manual control by acting on the lever 30.

The invention as herein disclosed is susceptible to many modifications and changes without departing from the inventive idea. As an example, the linkages may be embodied by any desired means on condition that they be effective to produce the cited effects.

In the embodiment described hereinabove, the threading and return strokes are actuated through mechanical controls. However, it may be appreciated that such controls may be of any desired types, such as electric or electronic controls, without in any way affecting the machine operation.

The provision of auxiliary drive means constitutes an improvement to the inventive device, because a return stroke may be obtained by simply reversing the movements transmitted during the threading step.

Furthermore, all of the details may be replaced with other, technically equivalent elements.

In practicing the invention, the materials used, and the dimensions and contingent shapes, may be any selected ones to meet individual requirements and suit the state of the art.

I claim:

1. A device for threading knit articles onto the pin holder ring of a linking machine, comprising, in a supporting frame associated with said linking machine, a carriage sliding along a runway rigid with said frame and extending in a substantially tangential direction to said pin holder ring, a comb-like element being motion-wise rigid with said carriage and having a plurality of coplanar dents facing said pins, a transfer assembly cooperating with said dents, a means for kinematically and selectively connecting said carriage to said pin holder ring or to an auxiliary drive means, thereby said carriage, when kinematically connected to said pin holder ring, has a translation speed substantially equal to the peripheral speed of rotation of said pin holder ring during a knit article threading stroke, and a means for picking up one of said knit articles threaded onto said comb-like element to pre-arrange it into an advanced position on said dents.

2. A device according to claim 1, wherein said comb-like element is detachably associated with said carriage.

3. A device according to claim 1, characterized in that said means for kinematically and selectively connecting said carriage comprises adjustable cams on said carriage acting on a rocker arm element, linked to a switch-over device of the kinematic connection of said carriage to said pin holder ring, or alternatively, to said auxiliary drive means.

4. A device according to claim 1, characterized in that said transfer assembly comprises a tool holder assembly slidably engaged with a rocking frame pivoted to said supporting frame, said tool holder assembly being connected kinematically to a translatory motion cam, said rocking frame cooperating with a rocking motion cam, said cams being mounted coaxially on a first shaft connected kinematically to said linking machine, there being further provided a means for disengaging said rocking frame from said rocking motion cam during a return stroke of said comb-like element.

5. A device according to claim 3, characterized in that it comprises means for picking up one of said knit articles comprising a small cylinder rotating at a peripheral speed substantially equal in magnitude to the translation speed of said carriage during a threading stroke, said small cylinder being carried rotatably on an arm pivoted to said supporting frame and driven through a linkage by said switch-over device to bring said small cylinder close to said knit articles during a threading stroke and to retract it into a non-interfering position with said knit articles during a return stroke of said carriage.

6. A device according to claim 5, characterized in that said small cylinder is provided peripherally with a hooked pile liner.

7. A device according to claim 1, characterized in that a brush-like tool is associated with said tool holder assembly.

8. A device according to claim 7, characterized in that said brush-like tool is positioned with an inclination toward said pin holder ring relatively to the direction of advance of said comb-like element during said threading step.

* * * * *